US006065632A

United States Patent [19]

Moore, Jr.

[11] Patent Number: 6,065,632

[45] Date of Patent: May 23, 2000

[54] MAGNETICALLY STABILIZED BEVERAGE CONTAINER

[76] Inventor: Gary S. Moore, Jr., 910 Leighsford La. No. 4302, Arlington, Tex. 76006

[21] Appl. No.: 09/104,285

[22] Filed: Jun. 24, 1998

[51] Int. Cl.[7] ..... A45C 11/20

[52] U.S. Cl. ..... 220/483; 220/592.17; 220/62.12; 206/818

[58] Field of Search ..... 220/592.17, 483, 220/62.12, 592.27, 592.28; 206/818

[56] References Cited

U.S. PATENT DOCUMENTS

| | | | |
|---|---|---|---|
| 2,217,514 | 10/1940 | Henry | 206/818 |
| 2,863,585 | 12/1958 | Meshberg | 220/592.17 |
| 2,899,098 | 8/1959 | Gits | 220/592.17 |
| 3,480,145 | 11/1969 | Gladden | 206/818 |
| 3,556,341 | 1/1971 | Rains | 220/483 |
| 4,484,682 | 11/1984 | Crow | 206/818 |
| 5,186,350 | 2/1993 | McBride | 220/483 |
| 5,769,262 | 6/1998 | Yamada et al. | 220/592.17 |
| 5,873,486 | 2/1999 | Morgan | 220/483 |

*Primary Examiner*—Joseph M. Moy
*Attorney, Agent, or Firm*—Jerry C. Ray

[57] ABSTRACT

A container for beverages has a magnetic base which stabilizes the container when placed on metallic surfaces. The container is of double-wall construction, with concentric outer and inner wall sections, the wall sections being joined at their top portions. The diameter of each cylindrical (or tapered) section is such that an insulating space remains between outer and inner walls when assembled. Similarly, a space exists between the floor portions of each section; a magnet is disposed within the space between the floor sections and is held in position by a post extending from the outer floor section through an orifice in the magnet's center; alternatively the magnet is attached to an interior surface of the outer floor section. The magnetic field extends through the plastic material of the lower section, clamping the container a metal surfaces on which the container rests.

6 Claims, 3 Drawing Sheets

( VIEW 1-1 )

( VIEW 2-2 )

( VIEW 3-3 )

MAGNETICALLY STABILIZED BEVERAGE CONTAINER

BACKGROUND OF THE INVENTION

1. Field of the Invention

This invention relates to drinking vessels and other containers which attach magnetically to a metallic surface, and specifically to drinking vessels having double-wall construction with a basal magnet between the walls.

2. Description of the Related Art

Beverage containers are subject to spills for a variety of reasons. One such reason is when the surface on which the container rests is subject to motion, as on motor vehicles and heavy equipment such as bulldozers, tractors, etc. Various types of containers or holders for containers have been devised; these are mounted on or attached to the vehicle in different ways. McBride (U.S. Pat. No. 5,186,350) discloses a holder for beverage containers having a basal magnet secured to a steel anchor plate. Hanson (U.S. Pat. No. 3,610,459) discloses a combination of a serving tray and dishes, both of which have permanent magnets attached to them. Similarly, Henry (U.S. Pat. No. 2,217,514) discloses tableware in which magnets are embedded in recesses in the bottom of the dishes. Nothing in the prior art, however, discloses the elements or the same combinations as found in the improved magnetically-stabilized container described below.

SUMMARY OF THE INVENTION

The present invention is a magnetically-stabilized container for beverages, designed to remain in place even on lurching tractors, construction equipment, etc. The container has double walls, with a trapped layer of air or inert gas between the walls which forms an insulating barrier between the container's contents and the outside air. Different embodiments of the invention include cylindrical and tapered shapes. The double-wall construction is accomplished by forming an outer wall portion and an inner wall portion; both are open at one end and closed at the other end by a floor section. A space exists between the floor sections as well as between the wall sections.

Magnetic stabilization is achieved by a flat, disc-shaped magnet disposed between the floor sections. A post extends upward from the outer floor section, and engages an orifice in the center of the magnetic disc to hold the disc in position.

When the container is placed on a ferrous-metal surface, or on any surface attractable by a magnet, the magnetic disc clamps the container to the surface, preventing the container from overturning except under the most severe circumstances. A close-fitting lid cooperatively prevents the container's contents from sloshing out.

Based on the above, it is an object of this invention to provide a container for beverages which will magnetically clamp itself to a metallic surface.

A further object is to provide a magnetically-stabilized beverage container which is insulated and which has a close-fitting lid to further minimize spills.

Further objects are to achieve the above with devices that are compact, durable, simple, and reliable, yet inexpensive and easy to manufacture.

The specific nature of the invention, as well as other objects, uses, and advantages thereof, will clearly appear from the following description and from the accompanying drawings, the different views of which are not necessarily scale drawings.

CATALOG OF THE ELEMENTS

Figure 1:
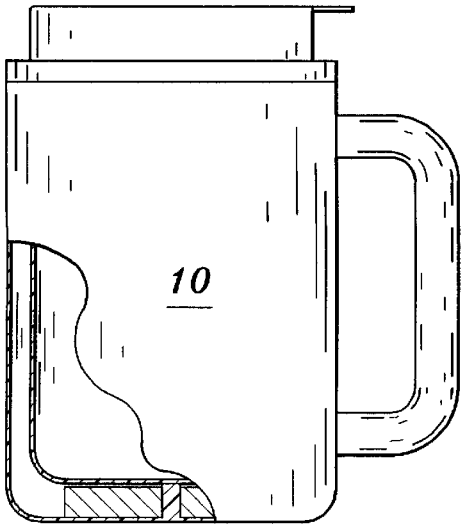
FIG. 1 is a cutaway view of the container showing its major components.

To aid in the correlation of the elements of the invention to the exemplary drawings, the following catalog of the elements is provided:

10 container
12 outer wall
14 inner wall
16 insulating space
18 outer floor portion
20 inner floor portion
22 magnet
24 orifice
26 post
28 handle
30 lid

DESCRIPTION OF THE PREFERRED EMBODIMENTS

Figure 2:
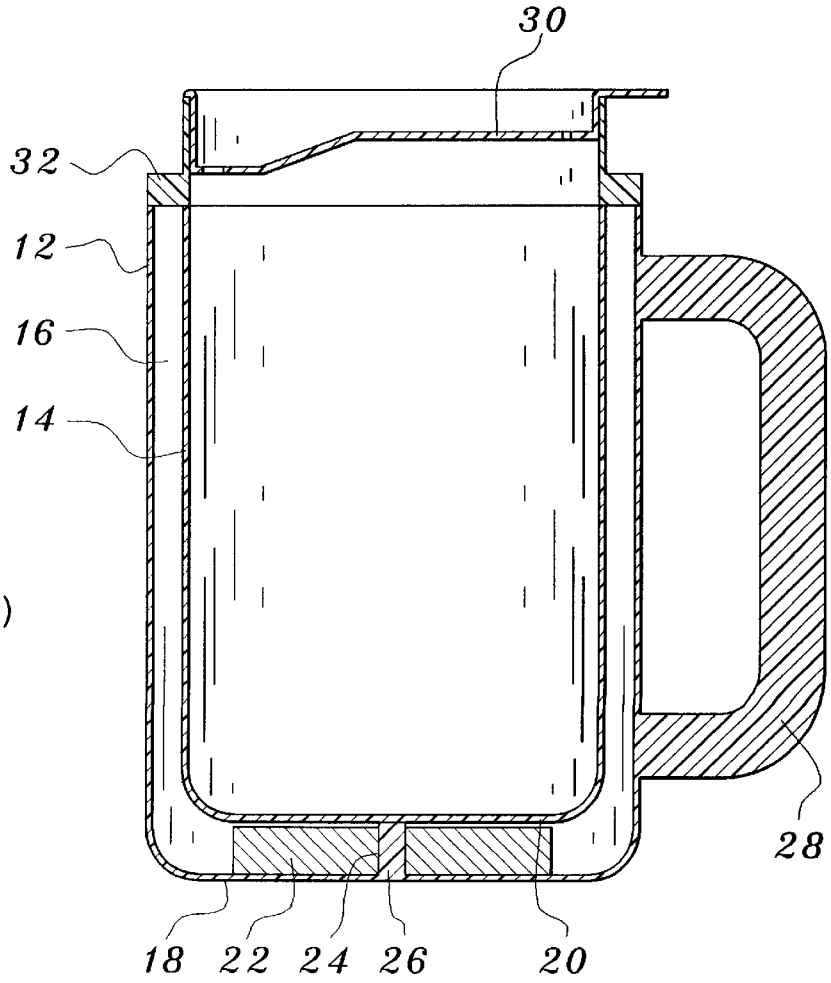
FIG. 2 is a cross section on View 1—1 of FIG. 3.

Referring now to the drawings, FIG. 1 shows a cutaway view of the magnetically stabilized container 10. FIG. 2 is a cross section on view 1—1 of FIG. 3. The container 10 has an inner wall 14 and outer wall 12. Inner wall 14 and outer wall 12 are dimensioned so they can be nested together and bonded at their upper extremities to form an integral container. Bond 32, at the upper extremities of the wall portions, is formed during the assembly process. As the two sections are assembled, an insulating space 16 is enclosed between them to retard heat flow in either direction.

The container walls are substantially cylindrical as shown in the drawings, or may taper inward from top to bottom to make the container easier to grip and to hold. Each wall has an integral floor portion. The insulating space 16 between the walls is continued between the inner floor section 18 and the outer floor section 20.

Figure 6:
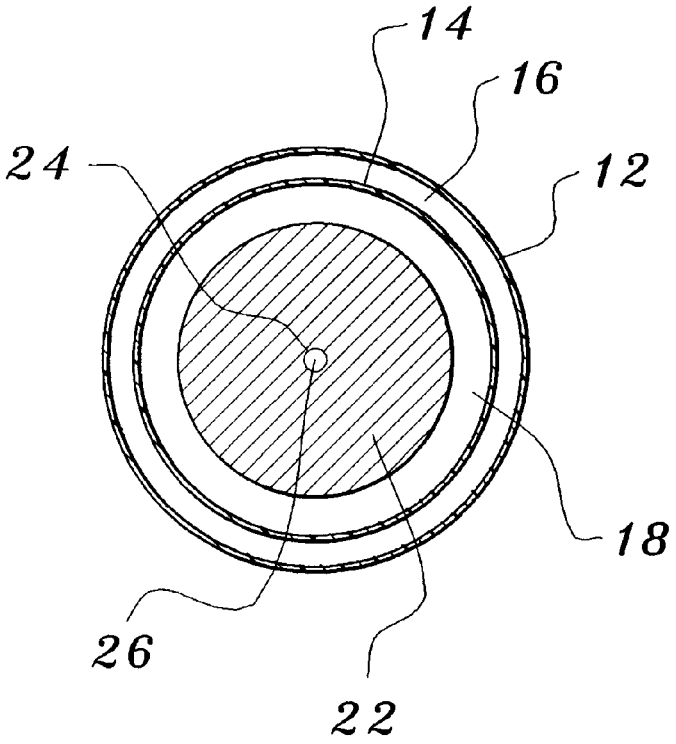
FIG. 6 is a cross section on View 3—3 of FIG. 4, detailing structure between the two floor is portions.

Referring again to FIG. 2, a magnet 22 is disposed in the space between the floor sections 18 and 20. The disc-shaped magnet 22 includes an orifice 24 in its center. A post 26 extends from the center of one of the floor portions, preferably the outer one. The post 26 engages orifice 24 in the magnet to retain the magnet 22 in position. A plan view of the post and magnet is seen in FIG. 6, which is a cross section on view 3—3 of FIG. 4. Another function of the post 26 is to provide support for the inner container.

Alternatively, the magnetic disc 22 may be retained in position by an annular ridge around its perimeter. The ridge is molded into an interior surface of the outer floor portion 18.

In another embodiment of the invention, the magnet is adhesively bonded to an interior surface of the outer floor section 18. This type of assembly leaves a space between the upper surface of the magnet and the inner floor section 20, so that the insulating space is uninterrupted. Attachment between the magnet and the floor section is achieved by chemical bonding or thermal bonding.

Magnet 22 is preferably of the ceramic type; the magnet may be molded so that its surface conforms to the contours of the floor section. In an alternate method of manufacture a ferrous-metal-impregnated plastic is poured into the base of the outer wall section and allowed to solidify while exposed to a magnetic field. The resulting magnet rests on outer floor portion 18, and is integral with the container so that its weight serves as ballast while the magnetic field clamps the container to a metallic surface.

Figure 3:
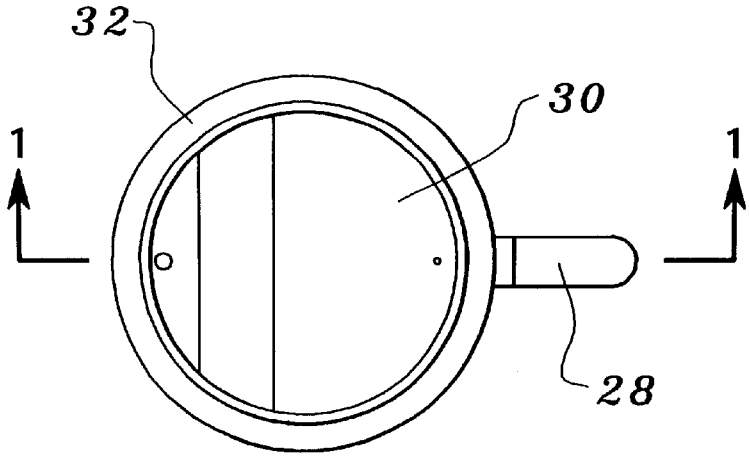
FIG. 3 is a top plan view of the container.
Figure 4:
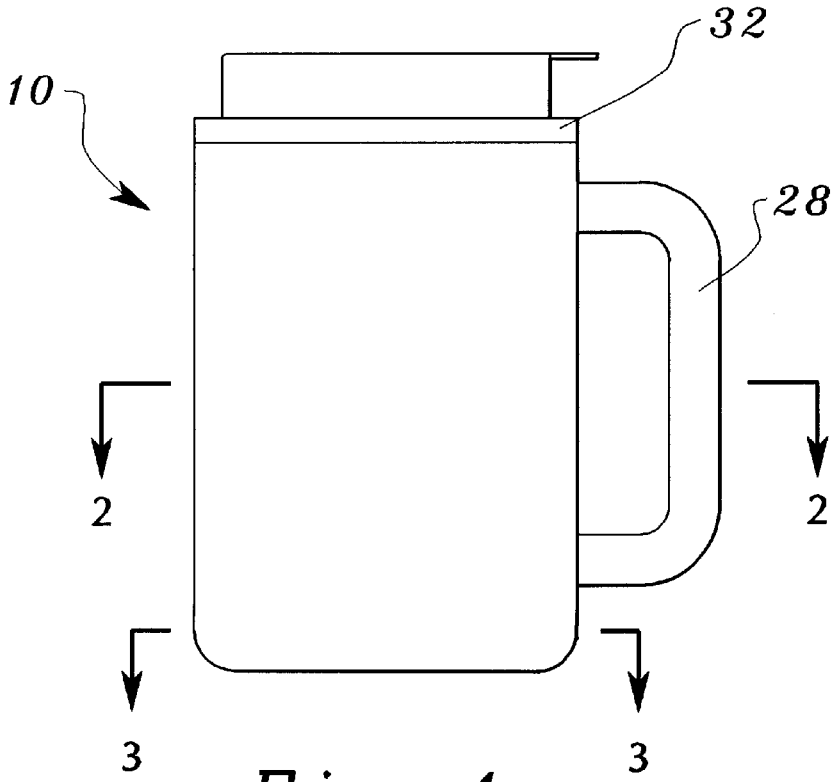
FIG. 4 is a side elevation of the container.
Figure 5:
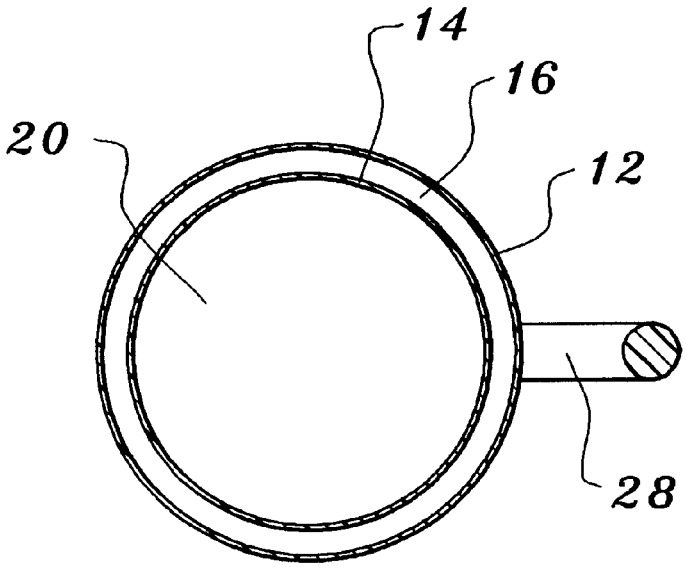
FIG. 5 is a cross section taken on View 2—2 of FIG. 4, showing a section through the central portion of the container.

Container 10 is completed by a handle 28 and a lid 30, shown in FIGS. 3 and 4. Lid 30 is sized to fit closely into the container's top, and is held in place by friction. A tab, shown in FIGS. 1 & 2, is positioned above handle 28; the tab is used to push lid 30 off the container. FIG. 5 shows a cross section of the container 10 and the handle 28 near its middle. FIG. 6 is cross section below the handle, on view 3—3 of FIG. 4, showing the magnet in position in the base of the container.

The restrictive description and drawings of the specific examples above do not point out what an infringement of this patent would be, but are to enable one skilled in the art to make and use the invention. Various modifications can be made in the construction, material, arrangement, and operation, and still be within the scope of my invention. The limits of the invention and the bounds of the patent protection are measured by and defined in the following claims.

I claim as my invention:

1. A magnetically stabilized container for beverages, comprising:

an outer wall including an outer floor portion at one end thereof, an inner wall including an inner floor portion at one end thereof, a bond joining an upper extremity of said outer wall to an upper extremity of said inner wall, said outer wall and said inner wall being separated by an insulating space therebetween, said outer floor portion and said inner floor portions being separated by an insulating space therebetween, a magnet disposed in said space between said floor portions, said magnet being disc-shaped, said magnet including an orifice in a center thereof, a post extending from said outer floor portion, said post engaging said orifice to retain said magnet in position, and an openable lid.

2. A magnetically stabilized container for beverages, comprising:

an outer wall including an outer floor portion at one end thereof, an inner wall including an inner floor portion at one end thereof, a bond joining an upper extremity of said outer wall to an upper extremity of said inner wall, said outer wall and said inner wall being separated by an insulating space therebetween, said outer floor portion and said inner floor portions being separated by an insulating space therebetween, a magnet disposed in said space between said floor portions, said magnet being disc-shaped, and said magnet being retained in position by an annular ridge on one said floor portion.

3. The invention as described in claim 1, further comprising:

a handle integral with and extending from said outer wall, and a tab integral with and extending from said openable lid, said tab for removing said lid from said container.

4. The invention as described in claim 1, wherein said magnet is adhesively bonded to an interior surface of said outer floor portion.

5. A method for making a magnetically-stabilized beverage container, comprising the following steps:

forming a substantially cylindrical outer container, said outer container being closed at one end, forming a substantially cylindrical inner container of a smaller diameter than said outer container, said inner container being closed at one end, placing a disc-shaped magnet against an interior surface of a closed end of said outer container, assembling said inner container and said outer container so that an insulating space is included between said inner container and said outer container, and bonding an upper extremity of said inner container to an inner extremity of said outer container.

6. The method as described in claim 5, further comprising the following steps:

forming a post extending upwardly from a floor of said outer container, forming an orifice in a center of said disc-shaped magnet, said post engaging said orifice to retain said magnetic disc in position.

* * * * *